US011682402B2

(12) United States Patent
Lee et al.

(10) Patent No.: US 11,682,402 B2
(45) **Date of Patent: *Jun. 20, 2023**

(54) BINAURAL RENDERING METHOD AND APPARATUS FOR DECODING MULTI CHANNEL AUDIO

(71) Applicant: Electronics and Telecommunications Research Institute, Daejeon (KR)

(72) Inventors: Yong Ju Lee, Daejeon (KR); Jeong Il Seo, Daejeon (KR); Jae Hyoun Yoo, Daejeon (KR); Seung Kwon Beack, Seoul (KR); Jong Mo Sung, Daejeon (KR); Tae Jin Lee, Daejeon (KR); Kyeong Ok Kang, Daejeon (KR); Jin Woong Kim, Daejeon (KR); Tae Jin Park, Daejeon (KR); Dae Young Jang, Daejeon (KR); Keun Woo Choi, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 164 days.

This patent is subject to a terminal disclaimer.

(21) Appl. No.: 17/201,943

(22) Filed: Mar. 15, 2021

(65) Prior Publication Data

US 2021/0201923 A1 Jul. 1, 2021

Related U.S. Application Data

(63) Continuation of application No. 16/841,428, filed on Apr. 6, 2020, now Pat. No. 10,950,248, which is a (Continued)

(30) Foreign Application Priority Data

Jul. 25, 2013 (KR) ..... 10-2013-0087919
Sep. 2, 2013 (KR) ..... 10-2013-0104913
Jul. 25, 2014 (KR) ..... 10-2014-0094746

(51) Int. Cl.
*G10L 19/008* (2013.01)
*H04S 7/00* (2006.01)

(52) U.S. Cl.
CPC ..... *G10L 19/008* (2013.01); *H04S 7/00* (2013.01); *H04S 7/30* (2013.01); *H04S 2400/01* (2013.01); *H04S 2400/03* (2013.01)

(58) Field of Classification Search
CPC ..... G10L 19/008; G10L 19/06; G10L 19/167; H04S 1/005; H04S 1/007; H04S 3/004;
(Continued)

(56) References Cited

U.S. PATENT DOCUMENTS 5,371,799 A 12/1994 Lowe et al.
5,436,975 A 7/1995 Lowe et al.
(Continued)

FOREIGN PATENT DOCUMENTS

CN 1630434 A 6/2005
CN 101366081 A 2/2009
(Continued)

OTHER PUBLICATIONS

Jo et al., Beyond Surround sound—Creation, Coding and Reproduction of 3-D Audio Soundtracks, Audio Engineering Society, 2011, whole document (Year: 2011).
(Continued)

*Primary Examiner* — Gerald Gauthier
(74) *Attorney, Agent, or Firm* — William Park & Associates Ltd.

(57) ABSTRACT

Disclosed is a binaural rendering method and apparatus for decoding a multichannel audio signal. The binaural rendering method may include: extracting an early reflection component and a late reverberation component from a
(Continued)

binaural filter; generating a stereo audio signal by performing binaural rendering of a multichannel audio signal base on the early reflection component; and applying the late reverberation component to the generated stereo audio signal.

10 Claims, 13 Drawing Sheets

Related U.S. Application Data continuation of application No. 16/245,024, filed on Jan. 10, 2019, now Pat. No. 10,614,820, which is a continuation of application No. 15/838,031, filed on Dec. 11, 2017, now Pat. No. 10,199,045, which is a continuation of application No. 15/131,623, filed on Apr. 18, 2016, now Pat. No. 9,842,597, which is a continuation of application No. 14/341,554, filed on Jul. 25, 2014, now Pat. No. 9,319,819.

(58) Field of Classification Search

CPC ... H04S 7/00; H04S 7/30; H04S 7/304; H04S 7/305; H04S 7/306; H04S 2400/01; H04S 2400/03; H04S 1/00; H04S 3/002; H04S 3/008; H04S 3/02; H04S 5/00; G10K 15/12; H03H 17/0266; H04M 3/56; H04R 3/04; H04R 5/02

See application file for complete search history.

(56) References Cited

U.S. PATENT DOCUMENTS 5,596,644 A 1/1997 Abel et al.
5,742,689 A 4/1998 Tucker et al.
5,987,142 A 11/1999 Courneau et al.
6,180,866 B1 1/2001 Kitamura
6,188,769 B1 2/2001 Jot et al.
6,628,787 B1 * 9/2003 McGrath ..... H04S 3/02 381/17
6,639,989 B1 10/2003 Zacharov et al.
6,925,426 B1 * 8/2005 Hartmann ..... H04R 3/04 381/1
6,928,179 B1 * 8/2005 Yamada ..... H04S 3/004 381/310
6,970,569 B1 11/2005 Yamada
7,099,482 B1 8/2006 Jot et al.
7,146,296 B1 12/2006 Carlbom et al.
7,215,782 B2 5/2007 Chen
7,536,021 B2 5/2009 Dickins et al.
7,903,824 B2 3/2011 Faller et al.
7,936,887 B2 5/2011 Smyth
8,081,762 B2 12/2011 Ojala et al.
8,265,284 B2 9/2012 Villemoes et al.
8,270,616 B2 9/2012 Slamka et al.
8,325,929 B2 12/2012 Koppens et al.
9,215,544 B2 12/2015 Faure et al.
9,226,089 B2 12/2015 Mundt et al.
9,319,819 B2 4/2016 Lee et al.
9,344,826 B2 5/2016 Ramo et al.
9,462,387 B2 * 10/2016 Oomen ..... H04S 7/306
9,842,597 B2 12/2017 Lee et al.
9,918,179 B2 * 3/2018 Kuhr ..... H04S 3/004
9,986,365 B2 5/2018 Lee et al.
10,199,045 B2 2/2019 Lee et al.
10,614,820 B2 4/2020 Lee et al.
10,950,248 B2 * 3/2021 Lee ..... G10L 19/008
2002/0122559 A1 9/2002 Fay et al.
2003/0236814 A1 12/2003 Miyasaka et al.
2005/0018039 A1 * 1/2005 Lucioni ..... H04M 3/56 348/14.01
2005/0053249 A1 3/2005 Wu et al.
2005/0063551 A1 3/2005 Cheng et al.
2005/0276430 A1 12/2005 He et al.
2006/0045294 A1 3/2006 Smyth
2006/0086237 A1 4/2006 Burwen
2007/0019813 A1 * 1/2007 Hilpert ..... G10L 19/008 381/22
2007/0133831 A1 * 6/2007 Kim ..... H04S 3/02 381/313
2007/0140498 A1 6/2007 Moon et al.
2007/0160219 A1 7/2007 Jakka et al.
2007/0172086 A1 7/2007 Dickins et al.
2007/0213990 A1 * 9/2007 Moon ..... H04S 1/00 704/500
2007/0223708 A1 * 9/2007 Villemoes ..... H04S 3/004 381/17
2007/0223749 A1 * 9/2007 Kim ..... H04R 5/02 381/23
2007/0244706 A1 10/2007 Tsushima
2007/0280485 A1 * 12/2007 Villemoes ..... H04S 7/30 381/119
2007/0297616 A1 12/2007 Plogsties et al.
2008/0008327 A1 1/2008 Ojala et al.
2008/0008342 A1 1/2008 Sauk
2008/0031462 A1 2/2008 Walsh et al.
2008/0033729 A1 * 2/2008 Ko ..... H04S 3/002 704/500
2008/0037795 A1 * 2/2008 Ko ..... H04S 3/002 381/17
2008/0049943 A1 2/2008 Faller et al.
2008/0097750 A1 4/2008 Seefeldt et al.
2008/0175396 A1 7/2008 Ko et al.
2008/0192941 A1 * 8/2008 Oh ..... G10L 19/008 381/17
2008/0205658 A1 8/2008 Breebaart
2008/0240448 A1 10/2008 Gustafsson et al.
2008/0273708 A1 * 11/2008 Sandgren ..... H04S 1/005 381/63
2008/0306720 A1 12/2008 Nicol et al.
2009/0012796 A1 1/2009 Jung et al.
2009/0043591 A1 * 2/2009 Breebaart ..... G10L 19/008 704/500
2009/0046864 A1 2/2009 Mahabub et al.
2009/0103738 A1 4/2009 Faure et al.
2009/0129601 A1 * 5/2009 Ojala ..... H04S 3/004 381/1
2009/0144063 A1 6/2009 Beack et al.
2009/0281804 A1 11/2009 Watanabe et al.
2010/0017002 A1 1/2010 Oh et al.
2010/0017195 A1 * 1/2010 Villemoes ..... H03H 17/0266 381/1
2010/0046762 A1 * 2/2010 Henn ..... G10L 19/008 381/23
2010/0094631 A1 4/2010 Engdegard et al.
2010/0119075 A1 5/2010 Xiang et al.
2010/0191537 A1 * 7/2010 Breebaart ..... H04S 3/008 704/500
2010/0223061 A1 9/2010 Ojanpera
2010/0246832 A1 * 9/2010 Villemoes ..... G10L 19/008 381/17
2011/0044457 A1 * 2/2011 Seo ..... G10L 19/008 381/22
2011/0081023 A1 4/2011 Raghuvanshi et al.
2011/0135098 A1 * 6/2011 Kuhr ..... H04S 7/304 381/17
2011/0158416 A1 6/2011 Yuzuriha
2011/0170721 A1 * 7/2011 Dickins ..... H04S 7/306 381/300
2011/0211702 A1 9/2011 Mundt et al.
2011/0261966 A1 10/2011 Engdegard
2011/0264456 A1 10/2011 Koppens et al.
2011/0317522 A1 12/2011 Florencio et al.
2012/0010879 A1 * 1/2012 Tsujino ..... G10L 19/06 704/203
2012/0082319 A1 4/2012 Jot et al.
2012/0093323 A1 4/2012 Lee et al.
2012/0140938 A1 6/2012 Yoo
2012/0201405 A1 8/2012 Slamka et al.
2012/0213375 A1 8/2012 Mahabub et al.

(56) References Cited

U.S. PATENT DOCUMENTS

2012/0224702 A1* 9/2012 Den Brinker ..... G10L 19/008 381/23
2012/0243713 A1 9/2012 Hess
2012/0263311 A1* 10/2012 Neugebauer ..... G10K 15/12 381/63
2012/0314876 A1 12/2012 Vilkamo et al.
2012/0328107 A1 12/2012 Nyström et al.
2013/0058492 A1 3/2013 Silzle et al.
2013/0142341 A1 6/2013 Galdo et al.
2013/0202125 A1 8/2013 Sena et al.
2013/0216059 A1 8/2013 Yoo
2013/0236040 A1 9/2013 Crawford et al.
2013/0268280 A1 10/2013 Galdo et al.
2013/0268281 A1 10/2013 Walther
2013/0272527 A1* 10/2013 Oomen ..... H04S 7/306 381/17
2014/0019146 A1* 1/2014 Neuendorf ..... G10L 19/167 704/500
2014/0037094 A1 2/2014 Ma et al.
2014/0072126 A1 3/2014 Uhle et al.
2014/0153727 A1 6/2014 Walsh et al.
2014/0169568 A1 6/2014 Li et al.
2014/0270216 A1 9/2014 Tsilfidis et al.
2014/0348354 A1 11/2014 Christoph et al.
2014/0350944 A1 11/2014 Jot et al.
2014/0355793 A1* 12/2014 Dublin ..... H04S 5/00 381/302
2014/0355794 A1 12/2014 Morrell et al.
2014/0355795 A1 12/2014 Xiang et al.
2014/0355796 A1* 12/2014 Xiang ..... H04S 7/305 381/303
2015/0030160 A1* 1/2015 Lee ..... G10L 19/008 381/17
2015/0125010 A1 5/2015 Yang et al.
2015/0199973 A1 7/2015 Borsum et al.
2015/0213807 A1 7/2015 Breebaart et al.
2015/0256956 A1 9/2015 Jensen et al.
2015/0350801 A1* 12/2015 Koppens ..... H04S 1/007 381/1
2015/0358754 A1* 12/2015 Koppens ..... H04S 7/30 381/17
2016/0029144 A1 1/2016 Cartwright et al.
2016/0088407 A1 3/2016 Elmedyb et al.
2016/0142854 A1 5/2016 Fueg et al.
2016/0232902 A1 8/2016 Lee et al.
2016/0275956 A1 9/2016 Lee et al.
2018/0091927 A1 3/2018 Lee et al.
2018/0102131 A1 4/2018 Lee et al.
2021/0067898 A1* 3/2021 Neukam ..... H04S 7/305
2021/0201923 A1* 7/2021 Lee ..... H04S 7/30

FOREIGN PATENT DOCUMENTS

CN 101366321 A 2/2009
CN 101809654 A 8/2010
JP 2012227647 A 11/2012
KR 100754220 B1 9/2007
KR 1020080078907 A 8/2008
KR 1020100063113 A 6/2010
KR 1020100106193 A 10/2010
KR 1020110039545 A 4/2011
KR 1020120038891 A 4/2012
KR 101175592 B1 8/2012
KR 1020130004373 A 1/2013
WO 9914983 A1 3/1999
WO 9949574 A1 9/1999

OTHER PUBLICATIONS

Neuendorf et al., Unified Speech and Audio Coding Scheme for High Quality at Low Bitrates, IEEE, 2009, whole document (Year: 2009).

* cited by examiner

BINAURAL RENDERING METHOD AND APPARATUS FOR DECODING MULTI CHANNEL AUDIO

CROSS-REFERENCES TO RELATED APPLICATIONS

The present application is a continuation application of U.S. application Ser. No. 16/841,428, filed on Apr. 6, 2020, which is a continuation application of U.S. application Ser. No. 16/245,024, filed on Jan. 10, 2019, which is a continuation application of U.S. application Ser. No. 15/838,031, filed on Dec. 11, 2017, which is a continuation application of U.S. application Ser. No. 15/131,623, filed on Apr. 18, 2016, which is a continuation application of U.S. application Ser. No. 14/341,554, filed on Jul. 25, 2014, which claims priority to Korean Patent Application Nos. 10-2014-0094746, 10-2013-0087919, and 10-2013-0104913, filed on Jul. 25, 2014, Jul. 25, 2013, and Sep. 2, 2013, respectively, which are incorporated herein by reference in their entireties.

TECHNICAL FIELD

Embodiments of the following description relate to a binaural rendering method and apparatus for binaural rendering a multichannel audio signal, and more particularly, to a binaural rendering method and apparatus that may maintain the quality of a multichannel audio signal.

BACKGROUND ART

Currently, with the enhancement in the quality of multimedia content, content including a multichannel audio signal having a relatively large number of channels compared to a 5.1-channel audio signal, such as a 7.1-channel audio signal, a 10.2-channel audio signal, a 13.2-channel audio signal, and a 22.2-channel audio signal is increasingly used. For example, there have been attempts to use a multichannel audio signal such as a 13.2-channel audio signal in the movie field and to use a multichannel audio signal such as a 10.2-channel audio signal and a 22.2-channel audio signal in a high quality broadcasting field such as an ultra high definition television (UHDTV).

However, user terminals of individual users may play back a stereotype audio signal such as a stereo speaker or a headphone. Accordingly, a high quality multichannel audio signal needs to be converted to a stereo audio signal that can be processed at a user terminal.

A down-mixing technology may be utilized for such a conversion process. Here, the down-mixing technology according to the related art generally down-mixes a 5.1-channel or 7.1 channel audio signal to a stereo audio signal. To this end, by making an audio signal pass a filter such as a head-related transfer function (HRTF) and a binaural room impulse response (BRIR) for each channel, a stereotype audio signal may be extracted.

However, the number of filters increases according to an increase in the number of channels and, in proportion thereto, a calculation amount also increases. In addition, there is a need to effectively apply a channel-by-channel feature of a multichannel audio signal.

DESCRIPTION OF INVENTION

Subjects

The present invention provides a method and apparatus that may reduce a calculation amount used for binaural rendering by optimizing the number of binaural filter when performing binaural rendering of a multichannel audio signal.

The present invention also provides a method and apparatus that may minimize a degradation in the sound quality of a multichannel audio signal and may also reduce a calculation amount used for binaural rendering, thereby enabling a user terminal to perform binaural rendering in real time and to reduce an amount of power used for binaural rendering.

Solutions

According to an aspect of the present invention, there is provided a binaural rendering method, including: extracting an early reflection component and a late reverberation component from a binaural filter; generating a stereo audio signal by performing binaural rendering of a multichannel audio signal base on the early reflection component; and applying the late reverberation component to the generated stereo audio signal.

The generating of the stereo audio signal may include generating the stereo audio signal by performing binaural rendering of a multichannel audio signal of M channels down-mixed from a multichannel audio signal of N channels.

The generating of the stereo audio signal may include performing binaural rendering of the multichannel audio signal by applying the early reflection component for each channel of the multichannel audio signal.

The generating of the stereo audio signal may include independently performing binaural rendering on each of a plurality of monotype audio signals constituting the multichannel audio signal.

The extracting of the early reflection component and the late reverberation component may include extracting the early reflection component and the late reverberation component from the binaural filter by analyzing a binaural room impulse response (BRIR) for binaural rendering.

The extracting of the early reflection component and the late reverberation component may include extracting the early reflection component and the late reverberation component frequency-dependently transited by analyzing a late reverberation time based on a BRIR of the stereo audio signal generated from the multichannel audio signal.

According to another aspect of the present invention, there is provided a binaural rendering method, including: extracting an early reflection component and a late reverberation component from a binaural filter; down-mixing a multichannel audio signal of N channels to a multichannel audio signal of M channels; generating a stereo audio signal by applying the early reflection component for each of M channels of the down-mixed multichannel audio signal and thereby performing binaural rendering; and applying the late reverberation component to the generated stereo audio signal.

The generating of the stereo audio signal may include independently performing binaural rendering on each of a plurality of monotype audio signals constituting the multichannel audio signal of M channels.

The extracting of the early reflection component and the late reverberation component may include extracting the early reflection component and the late reverberation component from the binaural filter by analyzing a BRIR for binaural rendering.

The extracting of the early reflection component and the late reverberation component may include extracting the early reflection component and the late reverberation component frequency-dependently transited by analyzing a late reverberation time based on a BRIR of the stereo audio signal generated from the multichannel audio signal.

According to still another aspect of the present invention, there is provided a binaural rendering apparatus, including: a binaural filter converter configured to extract an early reflection component and a late reverberation component from a binaural filter; a binaural renderer configured to generate a stereo audio signal by performing binaural rendering of a multichannel audio signal base on the early reflection component; and a late reverberation applier configured to apply the late reverberation component to the generated stereo audio signal.

The binaural renderer may generate the stereo audio signal by performing binaural rendering of a multichannel audio signal of M channels down-mixed from a multichannel audio signal of N channels.

The binaural renderer may perform binaural rendering of the multichannel audio signal by applying the early reflection component for each channel of the multichannel audio signal.

The binaural renderer may independently perform binaural rendering on each of a plurality of monotype audio signals constituting the multichannel audio signal.

The binaural filter converter may extract the early reflection component and the late reverberation component from the binaural filter by analyzing a BRIR for binaural rendering.

The binaural filter converter may extract the early reflection component and the late reverberation component frequency-dependently transited by analyzing a late reverberation time based on a BRIR of the stereo audio signal generated from the multichannel audio signal.

The binaural rendering apparatus may further include a binaural filter storage configured to store the binaural filter for binaural rendering.

Effects of the Invention

According to embodiments of the present invention it is possible to reduce a calculation amount used for binaural rendering by optimizing the number of binaural filter when performing binaural rendering of a multichannel audio signal.

According to embodiments of the present invention it is possible to minimize a degradation in the sound quality of a multichannel audio signal and to reduce a calculation amount used for binaural rendering, thereby enabling a user terminal to perform binaural rendering in real time and to reduce an amount of power used for binaural rendering.

DETAILED DESCRIPTION TO CARRY OUT THE INVENTION

Hereinafter, embodiments will be described with reference to the accompanying drawings.

A binaural rendering apparatus described with reference to FIGS. 1 through 10 may be included in a decoder configured to process a multichannel audio signal. The decoder may correspond to a playback device configured to play back the multichannel audio signal or may be included in the playback device. Meanwhile, w % ben the binaural rendering apparatus performs binaural rendering of a multichannel audio signal and thereby generates a stereo audio signal, the stereo audio signal may be played back through a 2-channel speaker or headphone.

Figure 1:
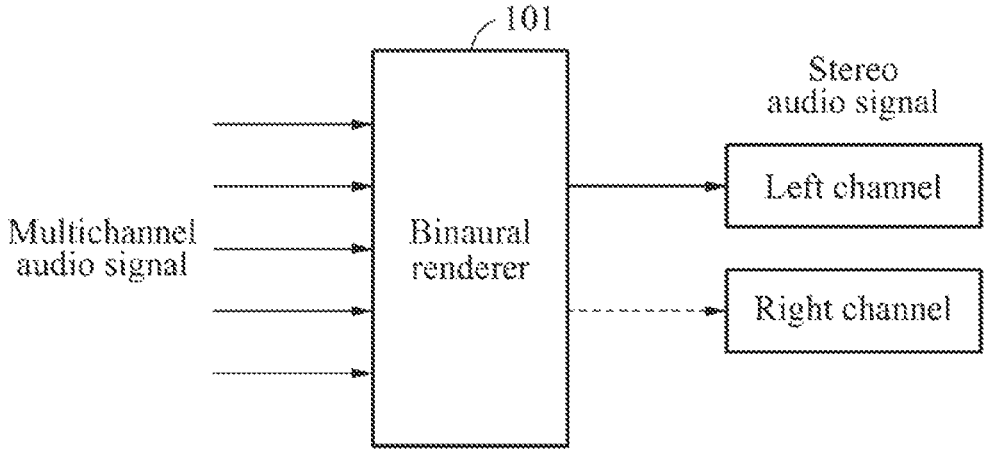
FIG. 1 illustrates a binaural rendering apparatus for rendering a multichannel audio signal to a stereo audio signal according to an embodiment.

FIG. 1 illustrates a binaural rendering apparatus for rendering a multichannel audio signal to a stereo audio signal according to an embodiment.

Referring to FIG. 1, a multichannel audio signal of N channels may be input to a binaural renderer 101. The binaural renderer 101 may generate a stereo audio signal by performing binaural rendering of the multichannel audio signal. The binaural renderer 101 may perform binaural rendering of the multichannel audio signal of N channels as is or may perform binaural rendering of a multichannel audio signal of M channels down-mixed from the multichannel audio signal of N channels. Here, the binaural renderer 101 may generate the stereo audio signal by applying a binaural filter to the multichannel audio signal.

The binaural renderer 101 may perform binaural rendering in a time domain, a frequency domain, or a quadrature mirror filter (QMF) domain. The binaural renderer 101 may apply a binaural filter to each of a plurality of mono audio signals constituting the multichannel audio signal. Here, the binaural renderer 101 may generate a stereo audio signal for each channel using a binaural filter corresponding to a playback location of each channel-by-channel audio signal.

Figure 2:
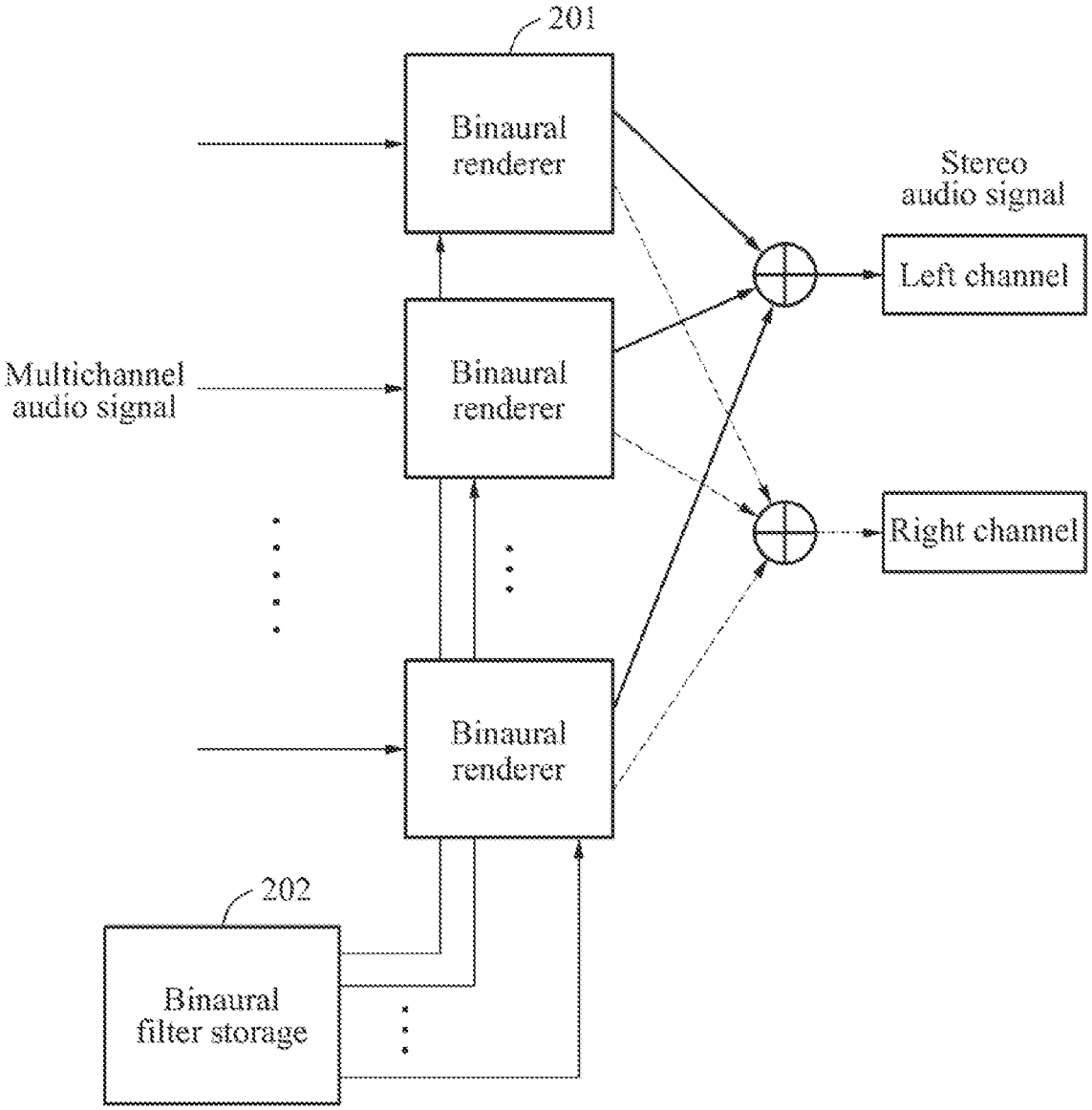
FIG. 2 illustrates a binaural rendering apparatus employing a binaural filter according to an embodiment.

FIG. 2 illustrates a binaural rendering apparatus employing a binaural filter according to an embodiment.

Referring to FIG. 2, the binaural rendering apparatus may include a plurality of binaural renderers 201 and a binaural filter storage 202. Here, each of the plurality of binaural renderers 201 may generate a stereo audio signal for each channel by applying a binaural filter for each channel of a multichannel audio signal.

Here, a binaural filter may be extracted from the binaural filter storage 202. The binaural rendering apparatus may generate a final stereo audio signal by separating and thereby mixing the generated stereo audio signal for a left channel and a right channel.

Figure 3:
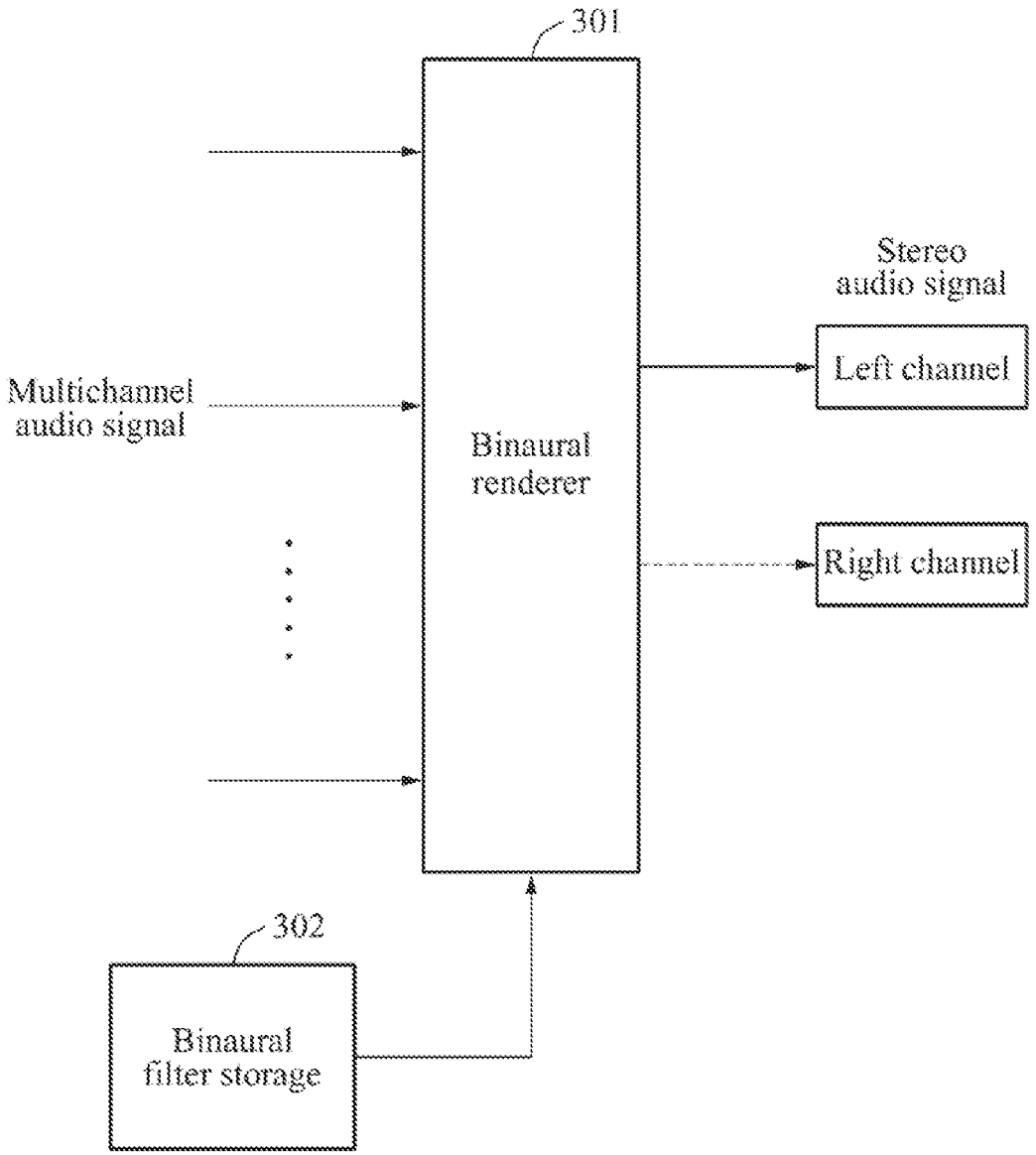
FIG. 3 illustrates a binaural rendering apparatus employing a binaural filter according to another embodiment.

FIG. 3 illustrates a binaural rendering apparatus employing a binaural filter according to another embodiment.

Referring to FIG. 3, the binaural rendering apparatus may include a binaural renderer 301 and a binaural filter storage 302. The binaural renderer 301 may generate a stereo audio signal by applying a binaural filter to a multichannel audio signal.

That is, the binaural rendering apparatus of FIG. 2 may generate a stereo audio signal for each channel by processing a multichannel audio signal for each channel and then separate and thereby mix the generated stereo audio signal for a left channel and a right channel. Meanwhile, the binaural rendering apparatus of FIG. 3 may generate a single stereo audio signal by processing a multichannel audio signal with respect to the entire channels.

Figure 4:
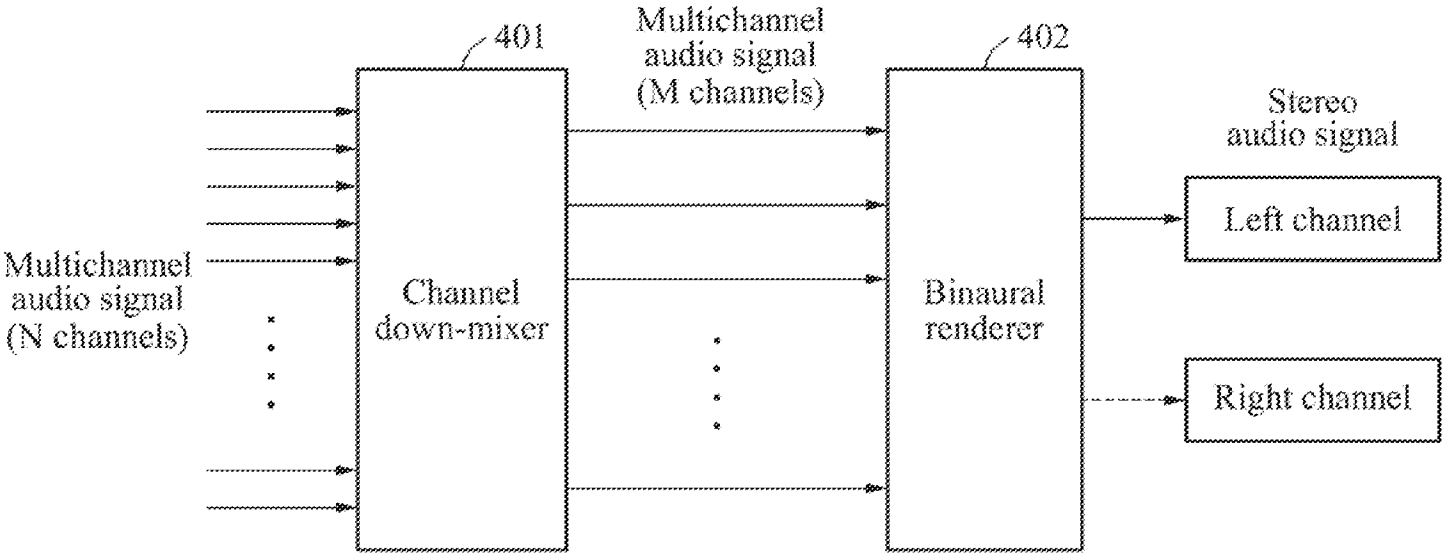
FIG. 4 illustrates a binaural rendering apparatus for down-mixing and then performing binaural rendering of a multichannel audio signal according to an embodiment.

FIG. 4 illustrates a binaural rendering apparatus for down-mixing and then performing binaural rendering of a multichannel audio signal according to an embodiment.

Referring to FIG. 4, the binaural rendering apparatus may include a channel down-mixer 401 and a binaural renderer 402. The channel down-mixer 401 may generate a multichannel audio signal of M channels by down-mixing a multichannel audio signal of N channels. For example, when N=22.2, M may be 10.2 or 8.1.

The binaural renderer 402 may generate a stereo audio signal by applying a binaural filter to the down-mixed multichannel audio signal of M channels. Here, the binaural renderer 402 may perform binaural rendering using a convolution method in a time domain, a fast Fourier transform (FFT) calculation method in a frequency domain, and a calculation method in a QMF domain.

Figure 5:
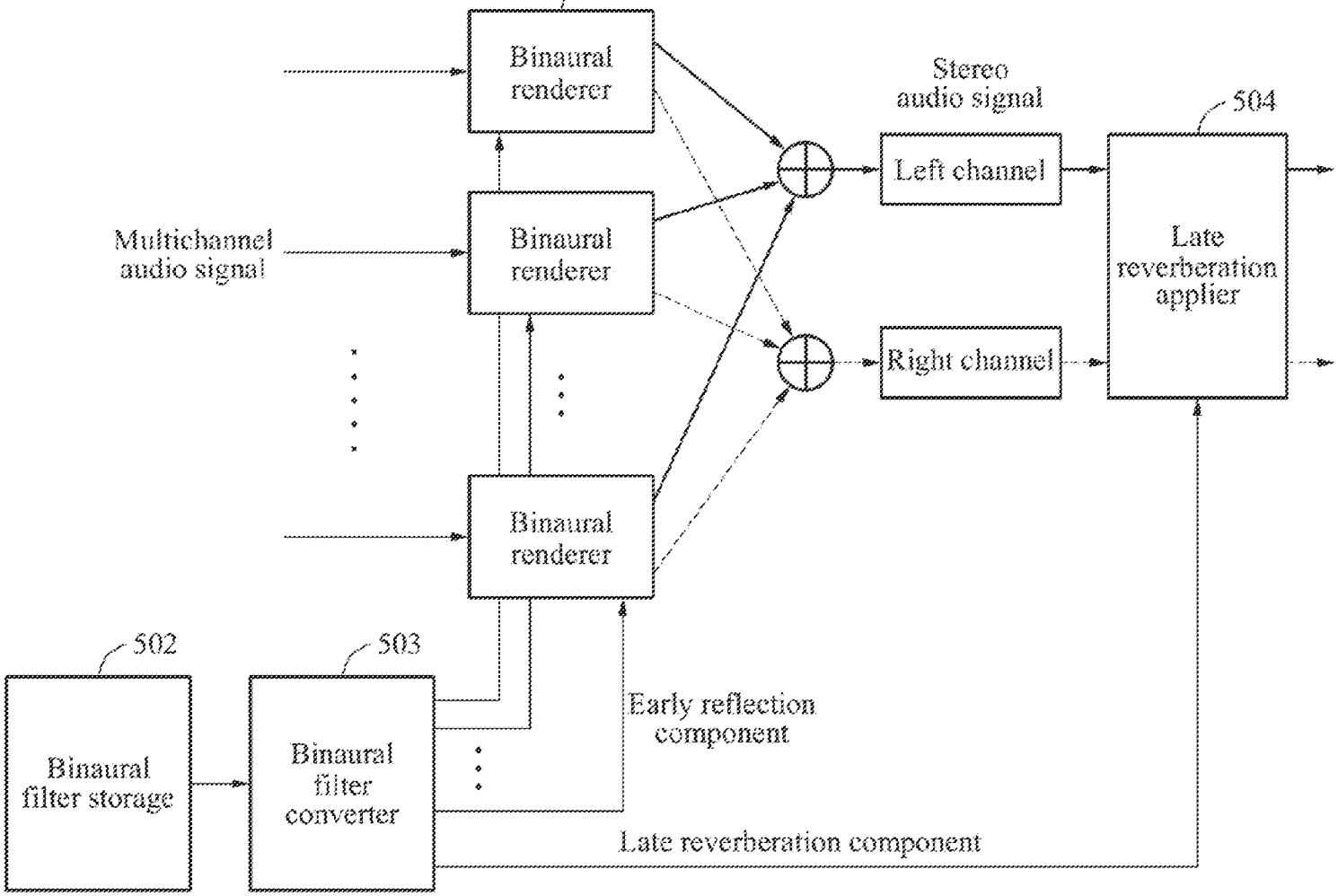
FIG. 5 illustrates a binaural rendering apparatus for applying a late reverberation component extracted from a binaural filter according to an embodiment.

FIG. 5 illustrates a binaural rendering apparatus for applying a late reverberation component extracted from a binaural filter according to an embodiment.

Referring to FIG. 5, the binaural rendering apparatus may include a plurality of binaural renderers 501, a binaural filter storage 502, a binaural filter converter 503, and a late reverberation applier 504.

The plurality of binaural renderers 501 may perform binaural rendering of a multichannel audio signal. Here, the plurality of binaural renderers 501 may perform binaural rendering for each channel of the multichannel audio signal. For example, the plurality of binaural renderers 501 may perform binaural rendering using an earl reflection component for each channel, transferred from the binaural filter converter 503.

The binaural filter storage 502 may store a binaural filter for binaural rendering of the multichannel audio signal. The binaural filter converter 503 may generate a binaural filter including an early reflection component and a late reverberation component by converting the binaural filter transferred from the binaural filter storage 502. Here, the early reflection component and the late reverberation component may correspond to a filter coefficient of the converted binaural filter.

The early reflection component may be used when the binaural renderer 501 performs binaural rendering of the multichannel audio signal. The late reverberation applier 504 may apply, to a finally generated stereo audio signal, the late reverberation component generated by the binaural filter converter 503, thereby providing a three-dimensional (3D) effect such as a space sense to the stereo audio signal.

In this instance, the binaural filter converter 503 may analyze the binaural filter stored in the binaural filter storage 502 and thereby generate a converted binaural rendering filter capable of minimizing an effect against the sound quality of the multichannel audio signal and reducing a calculation amount using the binaural filter.

As an example, the binaural filter converter 503 may convert a binaural filter by analyzing the binaural filter, by extracting data having a valid meaning and data having an invalid meaning from perspective of the multichannel audio signal, and then by deleting the data having the invalid meaning. As another example, the binaural filter converter 503 may convert a binaural filter by controlling a reverberation time.

Consequently, the binaural rendering apparatus of FIG. 5 may separate a binaural filter into an early reflection component and a late reverberation component by analyzing a BRIR for binaural rendering of a multichannel audio signal. In this case, the binaural rendering apparatus may apply the early reflection component for each channel of the multichannel audio signal when performing binaural rendering. The binaural rendering apparatus may apply the late reverberation component to the stereo audio signal generated through binaural rendering.

Accordingly, since only the early reflection component extracted from the binaural filter is used to perform binaural rendering, a calculation amount used for binaural rendering may be reduced. The late reverberation component extracted from the binaural filter is applied to the stereo audio signal generated through binaural rendering and thus, a space sense of the multichannel audio signal may be maintained.

Figure 6:
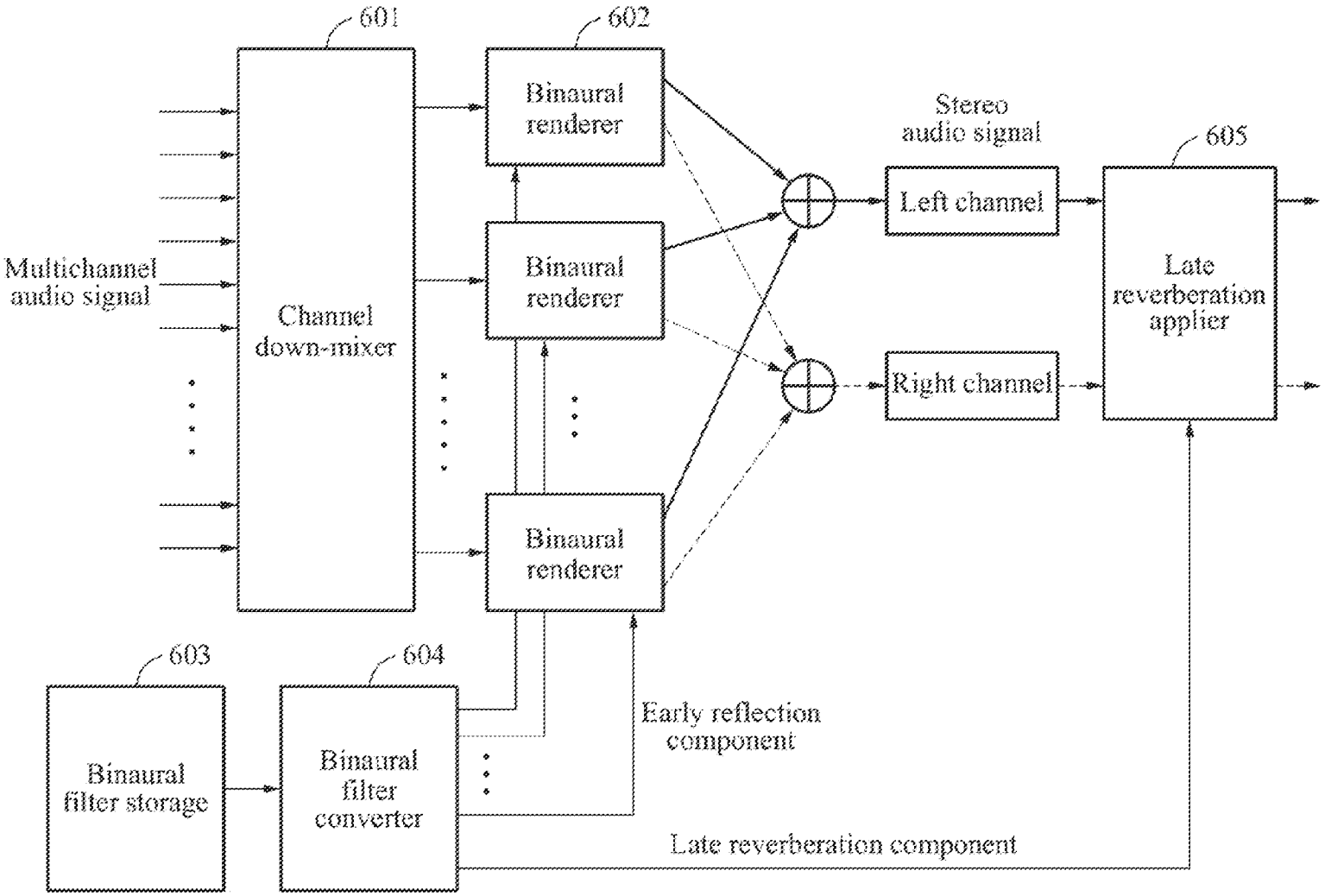
FIG. 6 illustrates a binaural rendering apparatus for applying a late reverberation component extracted from a binaural filter according to an embodiment.

FIG. 6 illustrates a binaural rendering apparatus for applying a late reverberation component extracted from a binaural filter according to an embodiment.

Referring to FIG. 6, the binaural rendering apparatus may include a channel down-mixer 601, a plurality of binaural renderers 602, a binaural filter storage 603, a binaural filter converter 604, and a late reverberation applier 605.

The binaural rendering apparatus of FIG. 6 includes the channel down-mixer 601, which differs from the binaural rendering apparatus of FIG. 5, and a remaining configuration is identical. The channel down-mixer 601 may generate a multichannel audio signal of M channels by down-mixing a multichannel audio signal of N channels. Here, N>M. The remaining configuration of the binaural rendering apparatus of FIG. 6 may refer to the description of FIG. 5.

Figure 7:
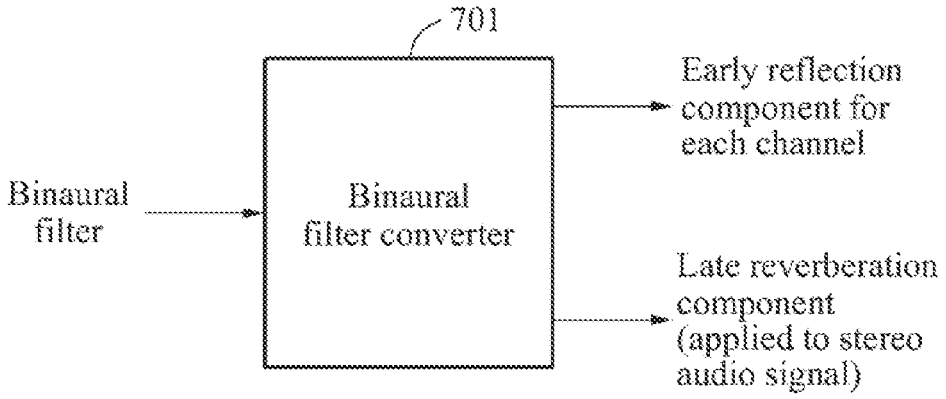
FIG. 7 illustrates a detailed operation of a binaural filter converter according to an embodiment.

FIG. 7 illustrates a detailed operation of a binaural filter converter according to an embodiment.

A binaural filter converter 701 may separate a binaural filter into an early reflection component and a late reverberation component by analyzing the binaural filter. The early reflection component may be applied for each channel of the multichannel audio signal and used when performing binaural rendering. Meanwhile, the late reverberation component may be applied to a stereo audio signal generated through binaural rendering and thus, the stereo audio signal may provide a 3D effect such as a space sense of the multichannel audio signal.

Figure 8:
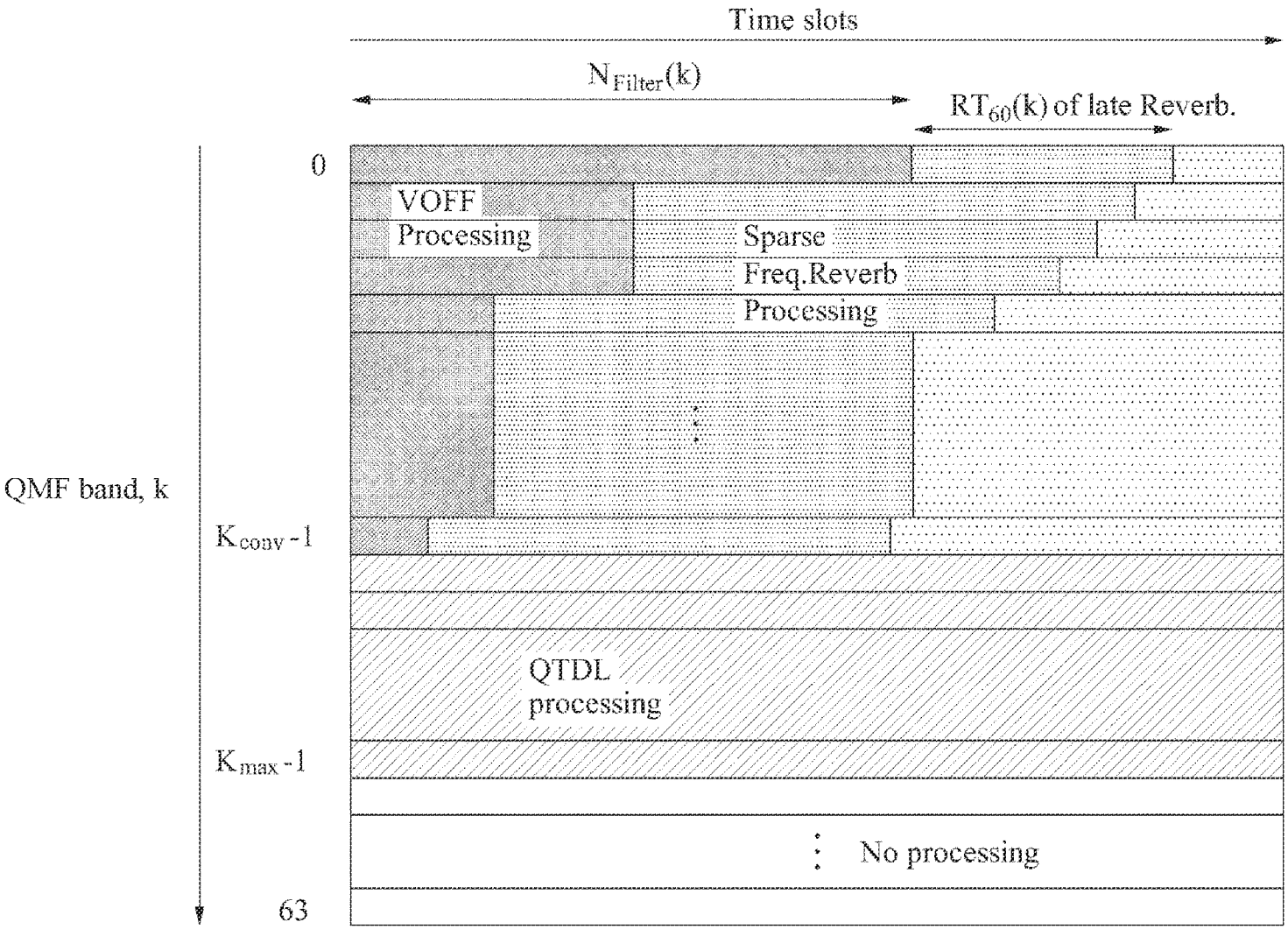
FIG. 8 illustrates a binaural rendering processing area in a frequency domain according to an embodiment.

FIG. 8 illustrates a binaural rendering processing area in a frequency domain according to an embodiment.

According to an embodiment, it is possible to generate a stereo audio signal capable of providing a surround sound effect through a 2-channel headphone by performing binaural rendering in the frequency domain. A multichannel audio signal corresponding to a QMF domain may be input to binaural rendering that operates in the frequency domain. A BRIR may be converted to complex QMF domain filters.

Referring to FIG. 8, a binaural renderer operating in the frequency domain may include three detailed constituent elements. The binaural renderer may perform binaural rendering using a variable order filtering in frequency domain (VOFF), a sparse frequency reverberator (SFR), and a QMF domain Tapped-Delay Line (QTDL).

Referring to FIG. 8, in an initial stage, the VOFF and the SFR are performed based on $N_{Filter}(k)$. In a subsequent stage, $RT_{60}(k)$ of late reverberation operates and the SFT partially operates. Although the QTDL operates over the entire time, the QTDL is performed only in a predetermined QMF band (k).

Figure 9:
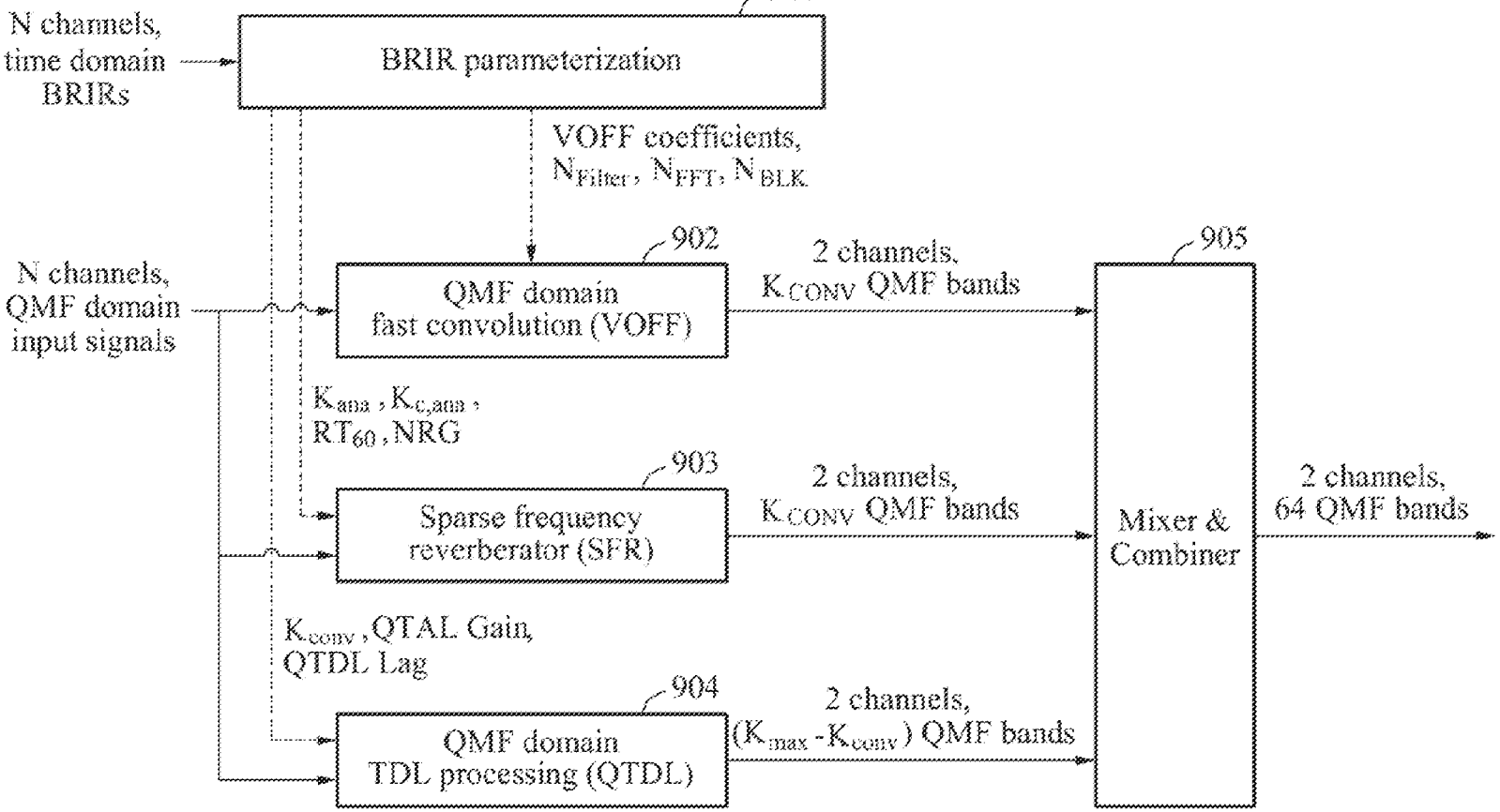
FIG. 9 illustrates an example of performing binaural rendering in a frequency domain according to an embodiment.

FIG. 9 illustrates an example of performing binaural rendering in a frequency domain according to an embodiment.

Referring to FIG. 9, a multichannel audio signal of N channels may be input to a binaural renderer. Here, the multichannel audio signal corresponds to a QMF domain. Also, a BRIR of N channels corresponding to the time domain may be input. The BRIR may be parameterized through BRIR parameterization 901, and may be used to perform a VOFF 902, an SFR 903, and a QTDL 904.

Referring to FIG. 9, the VOFF 902 may perform fast convolution in a QMF domain. A BRIR of the QMF domain may include a direct sound and an early reflection sound. Here, it may be determined that the initial reflection sound is transited to a late reverberation $N_{filter}$ through a bandwise reverberation time analysis. An audio signal of the QMF domain and the direct sound and the early reflection sound of the QMF domain may be processed according to a bandwise partitioned fast convolution for binaural rendering. A filter order of the BRIR of the QMF domain is frequency-dependent and may be expressed using the VOFF 902.

The SFR 903 may be used to generate a late reverberation component of the QMF domain of 2 channels. A waveform of the late reverberation component is based on a stereo audio signal down-mixed from the multichannel audio signal, and an amplitude of the late reverberation component may be adaptively scaled based on a result of analyzing the multichannel audio signal. The SFR 903 may output the late reverberation component based on an input signal of the QMF domain in which a signal frame of the multichannel audio signal is down-mixed to a stereo type, a frequency-dependent reverberation time, and an energy value induced from BRIR meta information.

The SFR 903 may determine that the late reverberation component is frequency-dependently transited from the early reflection component by analyzing a late reverberation time of a BRIR of a stereo audio signal. To this end, an attenuation in energy of a BRIR obtained in a complex-valued QMF domain may be induced from a late reverberation time in which transition from the early reflection component to the late reverberation component is analyzed.

The VOFF 902 and the SFR 903 may operate in $k_{conv}$ of a frequency band. The QTDL 904 may be used to process a frequency band higher than a high frequency band. In a frequency band ($k_{max}$-$k_{conv}$) in which the QTDL 904 is used, the VOFF 902 and a QMF domain reverberator may be turned off Processing results of the VOFF 902, the SFR 903, and the QTDL 904 may be mixed and be coupled for the respective 2 channels through a mixer and combiner 905. Accordingly, a stereo audio signal having 2 channels is generated through binaural rendering of FIG. 9, and the generated stereo audio signal has 64 QMF bands.

Each of constituent elements described with reference to FIG. 9 may be processed by a single processor, or may be processed by a plurality of processors corresponding to each constituent element.

Figure 10:
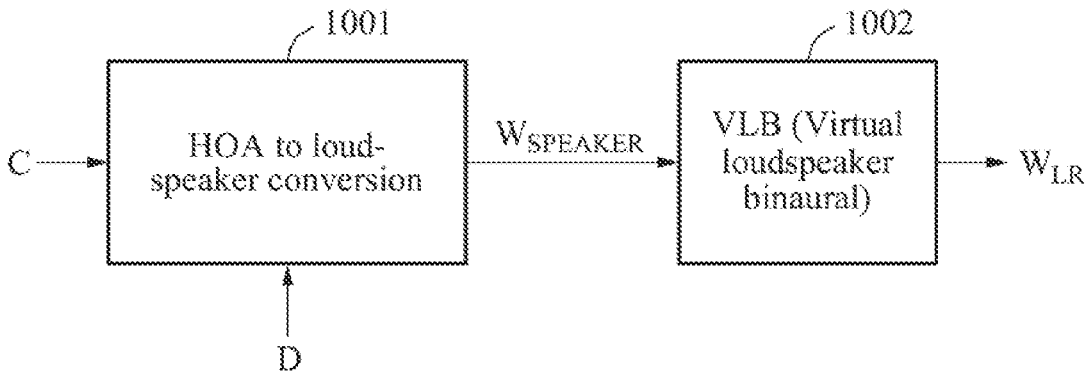
FIG. 10 illustrates an example of performing binaural rendering in a time domain according to an embodiment.

FIG. 10 illustrates an example of performing binaural rendering in a time domain according to an embodiment.

Performing binaural rendering in a time domain may be used to generate a 3D audio signal for a headphone. A process of performing binaural rendering in the time domain may indicate a process of converting a loudspeaker signal $W_{speaker}$ to a stereo audio signal $W_{LR}$.

Here, binaural rendering in the time domain may be performed based on a binaural parameter individually induced from a BRIR with respect to each loudspeaker location $\Omega_{speaker}$.

Referring to FIG. 10, in operation 1001, a high order Ambisonics (HOA) signal C may be converted to the loudspeaker signal $W_{speaker}$ based on a HOA rendering matrix D. The loudspeaker signal $W_{speaker}$ may be converted to the stereo audio signal $W_{LR}$ using a binaural filter.

Transition from an initial reflection component to a late reverberation component may occur based on a predetermined number of QMF bands. Also, frequency-dependent transmission from the initial reflection component to the late reverberation component may occur in the time domain.

Figure 11:
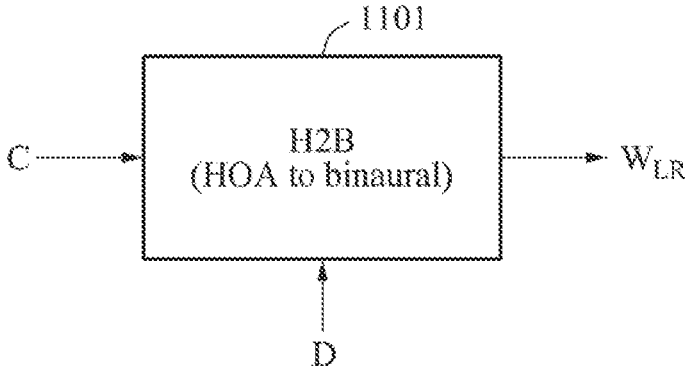
FIG. 11 illustrates another example of performing binaural rendering in a time domain according to an embodiment.

FIG. 11 illustrates another example of performing binaural rendering in a time domain according to an embodiment.

Referring to FIG. 11, binaural rendering in the time domain may indicate a process of converting a HOA signal C to a stereo audio signal $W_{LR}$ based on a binaural parameter.

Figure 12:
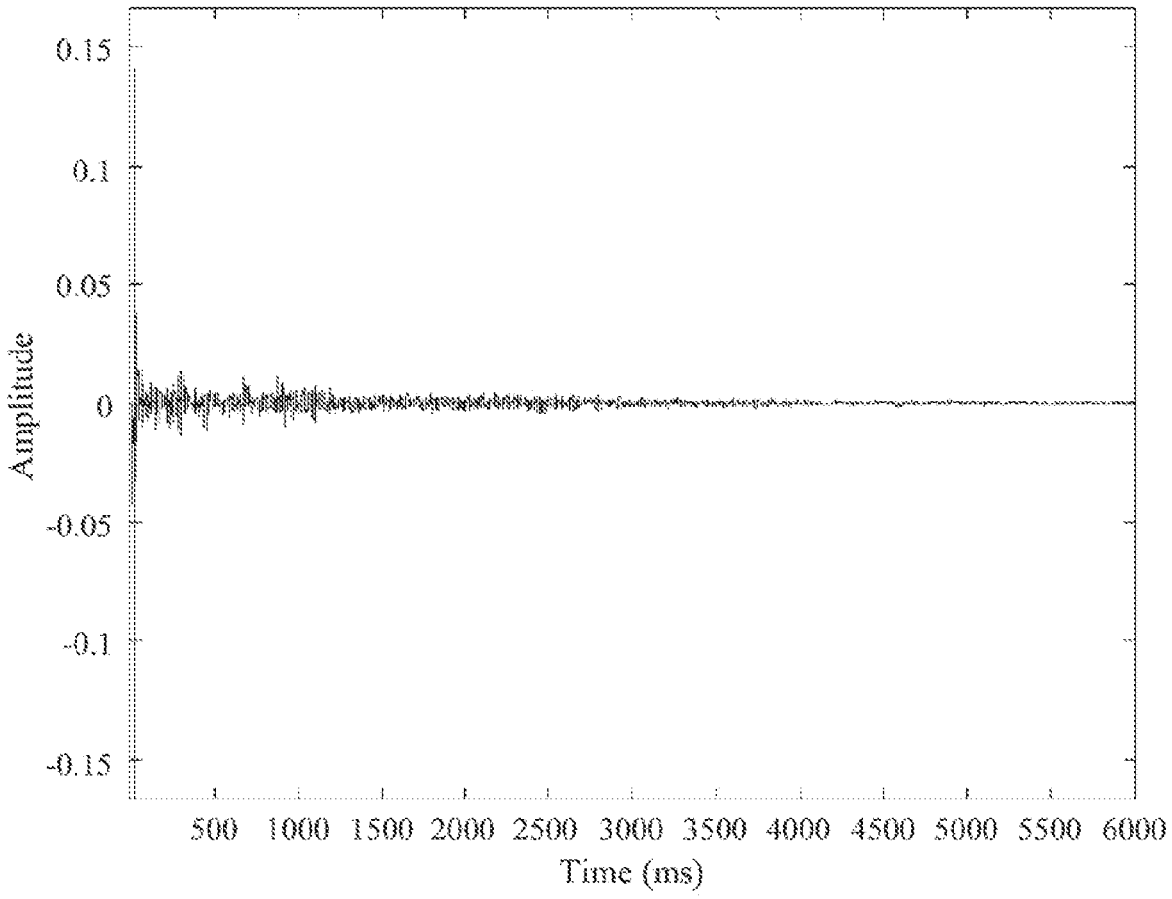
FIG. 12 is a graph showing an output result of a binaural filter according to an embodiment.

FIG. 12 is a graph showing an output result of a binaural filter according to an embodiment.

Figure 13:
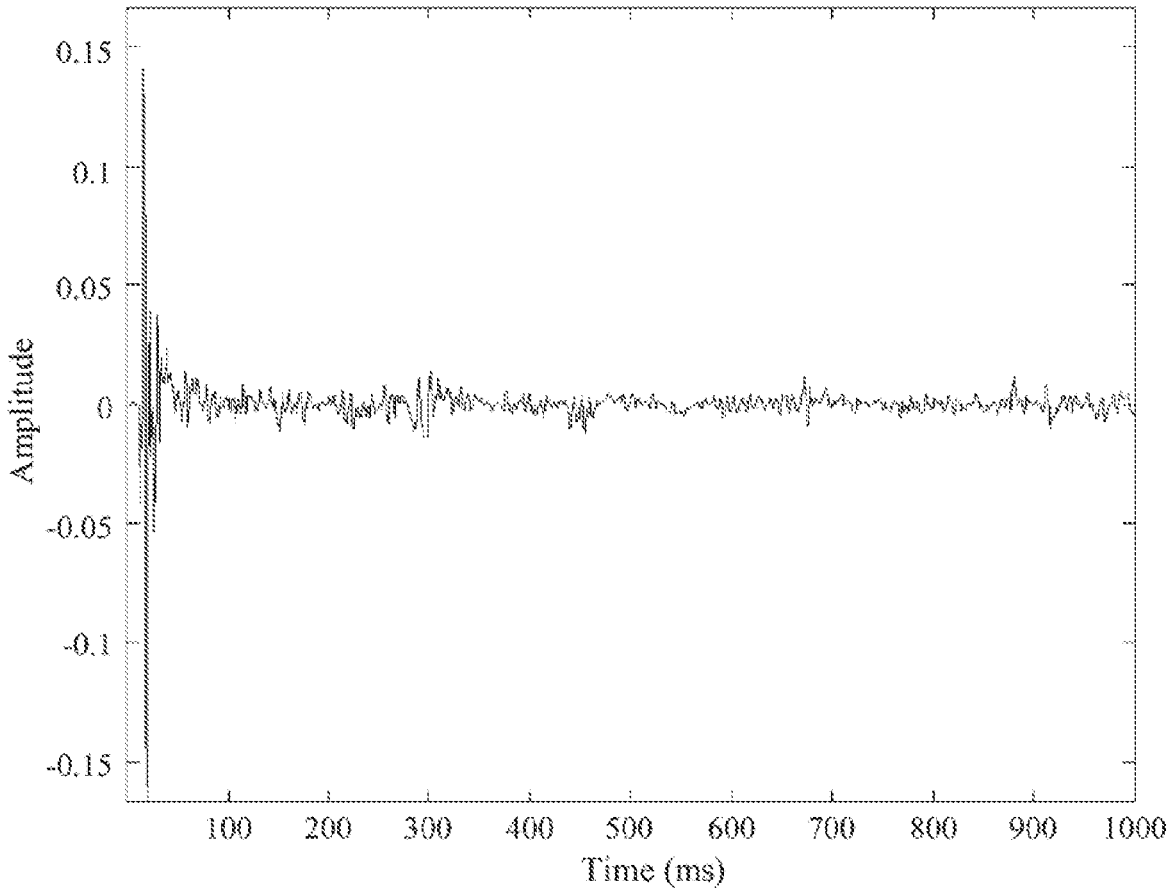
FIG. 13 is a graph showing an early reflection component according to an embodiment.

FIG. 13 is a graph showing an early reflection component according to an embodiment.

Figure 14:
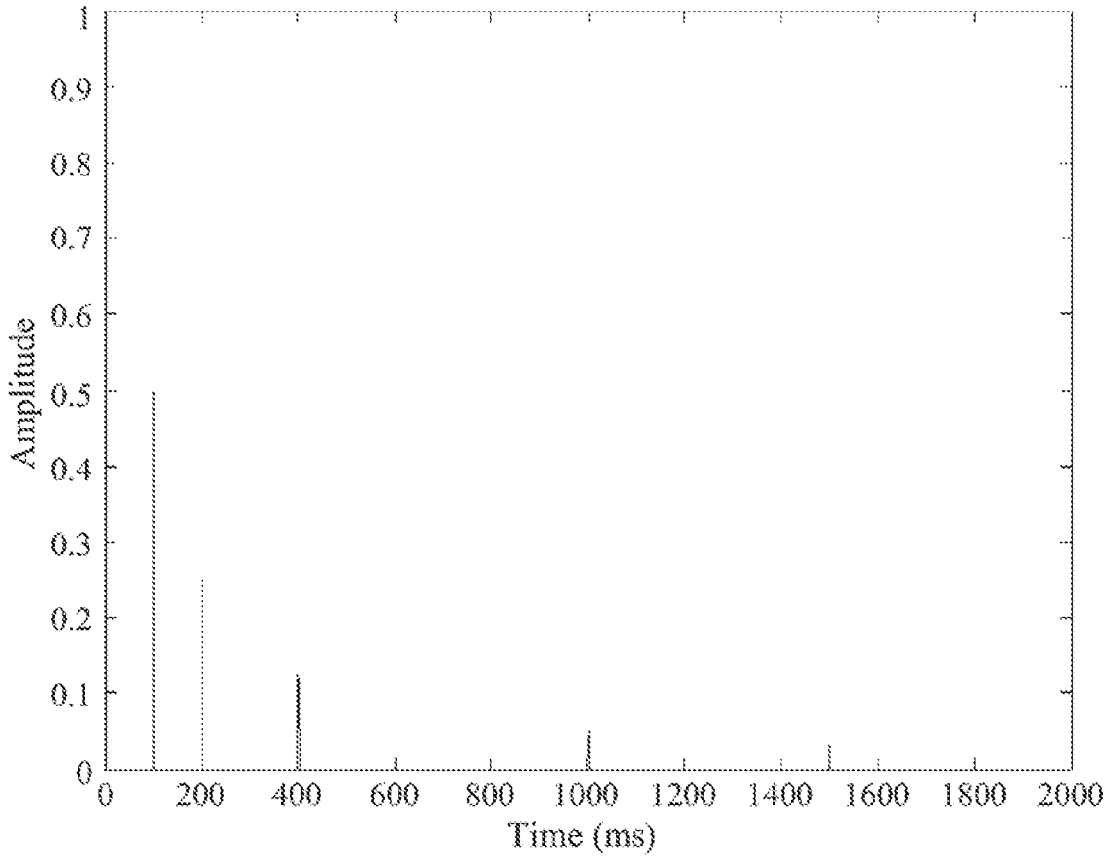
FIG. 14 is a graph showing a late reverberation component according to an embodiment.

FIG. 14 is a graph showing a late reverberation component according to an embodiment.

A result of FIG. 12 may be induced by combining results of FIGS. 13 and 14.

According to an embodiment, when performing binaural rendering of a multichannel audio signal available in a personal computer (PC), a digital multimedia broadcasting (DMB) terminal, a digital versatile disc (DVD) player, and a mobile terminal, the binaural rendering may be performed by separating an initial reflection component and a late reverberation component from a binaural filter and then using the initial reflection component. Accordingly, it is possible to achieve an effect in reducing a calculation amount used when performing binaural rendering without nearly affecting the sound quality of the multichannel audio signal. Since the calculation amount used for binaural rendering decreases, a user terminal may perform binaural rendering of the multichannel audio signal in real time. In addition, when the user terminal performs binaural rendering, an amount of power used at the user terminal may also be reduced.

The units described herein may be implemented using hardware components and software components. For example, the hardware components may include microphones, amplifiers, band-pass filters, audio to digital convertors, and processing devices. A processing device may be implemented using one or more general-purpose or special purpose computers, such as, for example, a processor, a controller and an arithmetic logic unit, a digital signal processor, a microcomputer, a field programmable array, a programmable logic unit, a microprocessor or any other device capable of responding to and executing instructions in a defined manner. The processing device may run an operating system (OS) and one or more software applications that run on the OS. The processing device also may access, store, manipulate, process, and create data in response to execution of the software. For purpose of simplicity, the description of a processing device is used as singular; however, one skilled in the art will appreciated that a processing device may include multiple processing elements and multiple types of processing elements. For example, a processing device may include multiple processors or a processor and a controller. In addition, different processing configurations are possible, such a parallel processors.

The software may include a computer program, a piece of code, an instruction, or some combination thereof, to independently or collectively instruct or configure the processing device to operate as desired. Software and data may be embodied permanently or temporarily in any type of machine, component, physical or virtual equipment, computer storage medium or device, or in a propagated signal wave capable of providing instructions or data to or being interpreted by the processing device. The software also may be distributed over network coupled computer systems so that the software is stored and executed in a distributed fashion. The software and data may be stored by one or more non-transitory computer readable recording mediums.

The above-described embodiments of the present invention may be recorded in non-transitory computer-readable media including program instructions to implement various operations embodied by a computer. The media may also include, alone or in combination with the program instructions, data files, data structures, and the like. Examples of non-transitory computer-readable media include magnetic media such as hard disks, floppy disks, and magnetic tape; optical media such as CD ROM disks and DVDs; magneto-optical media such as floptical disks; and hardware devices that are specially configured to store and perform program instructions, such as read-only memory (ROM), random access memory (RAM), flash memory, and the like. Examples of program instructions include both machine code, such as produced by a compiler, and files containing higher level code that may be executed by the computer using an interpreter. The described hardware devices may be configured to act as one or more software modules in order to perform the operations of the above-described embodiments of the present invention, or vice versa.

A number of examples have been described above. Nevertheless, it should be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

EXPLANATION OF SYMBOLS

501: binaural renderer
502: binaural filter storage
503: binaural filter converter
504: late reverberation applier

What is claimed is:

1. A binaural rendering method for multichannel audio signal in time domain, comprising:

identifying an early reflection and a late reverberation for a binaural rendering; and performing binaural rendering to convert a multichannel signal to a stereo signal based on the early reflection and the late reverberation, and wherein the multichannel audio signal corresponds to a QMF domain, and wherein an audio signal of the QMF domain and a direct sound and an early reflection sound of the QMF domain are processed according to a bandwise partitioned fast convolution for the binaural rendering.

2. The binaural rendering method of claim 1, wherein the binaural rendering is performed based on binaural parameter with respect to each loudspeaker location of the multichannel signal.

3. The binaural rendering method of claim 1, wherein the binaural rendering is performed by applying the late reverberating after applying the early reflection into the multichannel signal.

4. The binaural rendering method of claim 1, wherein the late reverberation is extracted based on a binaural room impulse response (BRIR) for binaural rendering.

5. A binaural rendering method in frequency domain, comprising:

determining an early reflection and a late reverberation for a binaural rendering;

converting a multichannel audio signal to a stereo audio signal by performing binaural rendering for the multichannel audio signal, wherein the binaural rendering is performed based on early reflection and late reverberation, wherein the multichannel audio signal corresponds to a QMF domain, and wherein an audio signal of the QMF domain and a direct sound and an early reflection sound of the QMF domain are processed according to a bandwise partitioned fast convolution for the binaural rendering.

6. The binaural rendering method of claim 5, wherein the early reflection is determined based on a binaural room impulse responses (BRIR) in the frequency domain.

7. The binaural rendering method of claim 5, wherein the late reverberation is scaled based on a result of the analyzing the multichannel audio signal.

8. A binaural renderer in frequency domain, comprising:

one or more processor configured to:

determine an early reflection and a late reverberation for a binaural rendering;

convert a multichannel audio signal to a stereo audio signal by performing binaural rendering for the multichannel audio signal, wherein the binaural rendering is performed based on early reflection and late reverberation, and wherein the multichannel audio signal corresponds to a QMF domain, and wherein an audio signal of the QMF domain and a direct sound and an early reflection sound of the QMF domain are processed according to a bandwise partitioned fast convolution for the binaural rendering.

9. The binaural renderer of claim 8, wherein the early reflection is determined based on a binaural room impulse responses (BRIR) in the frequency domain.

10. The method of claim 8, wherein the late reverberation is scaled based on a result of the analyzing the multichannel audio signal.

* * * * *